US007071398B2

(12) United States Patent
Hannes

(10) Patent No.: US 7,071,398 B2
(45) Date of Patent: Jul. 4, 2006

(54) ADJUSTABLE BRIDGE SYSTEM FOR A STRINGED INSTRUMENT

(76) Inventor: Roland R. Hannes, 8 VaBey Cir., Mill Valley, CA (US) 94941

( * ) Notice: Subject to any disclaimer, the term of this patent is extended or adjusted under 35 U.S.C. 154(b) by 14 days.

(21) Appl. No.: 10/515,778

(22) PCT Filed: Jul. 11, 2003

(86) PCT No.: PCT/US03/21581

§ 371 (c)(1),
(2), (4) Date: Nov. 24, 2004

(87) PCT Pub. No.: WO2004/008429

PCT Pub. Date: Jan. 22, 2004

(65) Prior Publication Data

US 2005/0150347 A1 Jul. 14, 2005

Related U.S. Application Data

(60) Provisional application No. 60/395,730, filed on Jul. 11, 2002, provisional application No. 60/427,815, filed on Nov. 20, 2002.

(51) Int. Cl.
*G10D 3/00* (2006.01)

(52) U.S. Cl. ..... 84/319

(58) Field of Classification Search ..... 84/307, 84/297 R, 290, 267
See application file for complete search history.

(56) References Cited

U.S. PATENT DOCUMENTS

| | | | | |
|---|---|---|---|---|
| 5,231,238 | A | 7/1993 | Adams | |
| 5,517,891 | A * | 5/1996 | Sica | 84/453 |
| 6,262,354 | B1 | 7/2001 | Solomon, Jr. | |
| 2003/0066407 | A1 * | 4/2003 | Shimooka et al. | 84/313 |
| 2003/0140763 | A1 | 7/2003 | Casamento | |
| 2004/0003703 | A1 * | 1/2004 | Chapman et al. | 84/453 |

* cited by examiner

*Primary Examiner*—Kimberly R. Lockett
(74) *Attorney, Agent, or Firm*—Johnson & Stainbrook, LLP; Craig M. Stainbrook; Larry D. Johnson

(57) ABSTRACT

A bridge system (10) for a stringed instrument having means to adjust independent bridge elements longitudinally, vertically, and laterally. The bridge (10) elements include a unit (20), a control anchor (300) having a ring (340) and bolted to the instrument body through an elongate opening in the ring (340). A longitudinal adjustment screw (390) connects the control anchor (300) to the saddle/base unit (20), and the structural base (100) includes a height adjustment screw (180) that engages the saddle (200). Multidimensional adjustments can be made with a single tool.

20 Claims, 6 Drawing Sheets

ADJUSTABLE BRIDGE SYSTEM FOR A STRINGED INSTRUMENT

This application is a 371 of PCT/US03/21581 which claims benefit of 60/395,730, filed Jul. 11, 2002 and claims benefit of 60/427,815 filed Nov. 20, 2002.

BACKGROUND OF THE INVENTION

1. Technical Field

The present invention relates generally to devices for fine tuning stringed musical instruments, and more particularly to an improved adjustable bridge system which secures the strings of the instrument on the instrument body while also providing for length, height, and spacing adjustments of the strings. The bridge system can be readily modified to provide only for length and height adjustments of the strings while retaining many of the overall advantages the invention.

2. Background Art

Stringed musical instruments are generally tuned in two ways: firstly, through harmonic tuning, which relates to string length and which is adjusted by altering the distance between the points at which a string contacts and rests upon the bridge and nut members of the instrument; secondly, through pitch tuning (also referred to as fine tuning), which relates to string tension and which is adjusted principally by tuning keys and secondarily by an adjustable bridge. As string tension is increased, the pitch raised, and as string tension is decreased, the pitch is lowered. Generally, the adjustable saddle provides for finer tuning than that achieved through tuning keys.

An adjustable bridge for a stringed instrument can provide a variety of mechanisms used to reposition its multiple saddles. In order to intonate each string harmonically by adjusting its length, the saddle of the string can be repositioned in the longitudinal direction (L). Usually, the saddle of each string can also be repositioned in the up/down, or height, direction (H) to adjust the string height. This serves to optimize and tailor the feel of the action of the instrument to the preferences of the musician. The option to reposition the saddle of each string in the latitudinal direction (S) to adjust the string spacing is a less common feature than the other two options, yet this adjustment can be just as essential if, for example, the user regularly pulls or pushes the outer strings off the playing surface of the neck when the outer strings are close to the edges of the neck.

Thus a bridge which provides length, height and spacing adjustment for each string is highly desirable. A bridge with all three adjustment option in combination will be referred to herein as LHS bridge. The prior art includes a variety of LHS bridges, some of which are considered below.

A bridge for a stringed instrument serves to transfer the vibrations of the strings to the instrument body, and the saddles are the points where most of this energy is transferred. Preferably, the vibrating energy of the string is never dampened by rattles or movements of the saddle, which is required to be rigid. Additionally, a maximum of energy is transferred from the point of string vibration at the saddle and into the instrument body. Satisfying these requirements has remained an enduring problem in the design of LHS bridges and of adjustable bridges in general, where each of the multiple saddles is traditionally required to be interconnected to the base of the bridge by multiple mechanical elements which are free to move in order to provide some or all of the separate adjustments. Thus each saddle is typically attached to the bridge by a connecting element which allows lateral free play but which weakens the rigidity of the saddle. Moreover, to provide height adjustment of the string, the saddle is typically required to be elevated in relation to its base or to the body of the instrument, such that a restricted amount of direct contact exists between the saddle and the instrument body. Therefore the flow of energy between the vibrating string and the instrument is likewise restricted.

Saddles adapted for use on acoustic stringed instruments, such as a steel-string guitar or a classical guitar, transfer the energy of the vibrating string directly downward into the instrument's soundboard. Therefore, the saddle is preferably perpendicular to the longitudinal line dividing the top face of the instrument. If the saddle angles away from the perpendicular, it will transfer the energy obliquely into the soundboard and will weaken the resonance of the instrument. Other stringed instruments such as solid body guitars likewise resonate optimally when the energy is transferred directly downward into the instrument. Thus the multiple saddles of an adjustable bridge preferably have a support which is perpendicular to the top face of the instrument and which is located below the point at which the string vibrates at the saddle. Since each of the saddles requires height adjustment, the mechanical elements employed for such a purpose should also serve as the perpendicular support. Traditionally, this has been partly resolved by using one or two height-adjusting screws that support and engage the saddles. The screws are typically located immediately next to the point at which the strings vibrate at the saddle, but they are not located underneath the string, which would provide advantages. Additionally, there is a very limited amount of space between the edge of the saddle and the point at which the string vibrates over the saddle. Therefore these screws have a diameter which is a small fraction of the width of the saddle and they provide a restricted amount of volume and of mass through which the vibrating energy of the string can be transferred downwardly.

Moreover, the ideal saddle should serve as an acoustically neutral connection between the string and the instrument in order to bring forth the natural sound of the instrument. It is widely recognized that the material used to make a saddle plays a significant role in the overall sound of a stringed instrument. Therefore the saddle material should not have an adverse characteristic impact on the resonating frequencies of the instrument. Accordingly, most of the builders of acoustic instruments, such as steel-string or classical guitars, long ago found it crucial that to select materials such as bone, different ivories, and other similar materials in order to produce a generally neutral saddle.

Known prior art adjustable bridges typically provide multiple saddles that must be repositioned relative to the supporting base of the bridge. In the prior art devices, each saddle is interconnected to the supporting base by mechanical elements such as screws which reposition the saddle. Alternatively, the saddle is adjusted by mechanical elements which apply an amount of pressure on the saddle significantly greater than the pressure applied by the string. This restricts the choice of material from which the saddles of an adjustable bridge can be fabricated; the preferred materials cannot be used because they tend to shatter under the pressure. In order not to shatter and in order to function properly, these saddles are typically made from various metals or artificial materials.

Saddles that include an array of mechanical elements are also prone to a loss of precision and integrity, either from wear and tear or from a typical succession of small accidental blows. This further diminishes the quality of the sound of the instrument and compels more visits to an instrument repairman.

Although the multiple saddles of prior art adjustable bridges can all be removed from the bridge, none are known that provide for easy frequent removal. Traditionally, a saddle is removed because it is damaged or functions improperly. In such a case, the saddle is replaced by an identical saddle that is painstakingly adjusted to the position previously occupied by the old saddle. This usually requires the use of one or more tools and may require the expertise of a repairman.

Finally, it should be noted that prior art adjustable bridges are typically provided as a single unit and are designed to be installed on one type of instrument only. Thus, for example, if such a bridge is adapted for use on a six-string instrument, it will not accommodate an additional saddle so that it can be used on a seven-string instrument without significantly altering the support base of the bridge and/or the device which attaches or anchors the bridge to the instrument. Likewise, this bridge cannot be used on a six-string instrument that uses different scale lengths for each string and thus may require a significantly slanted bridge.

Known prior art devices include those described, taught, or otherwise disclosed in the following patents:

U.S. Pat. No. 4,453,443, to Smith, which teaches a pitch stabilized string suspension system for minimizing detuning while playing by designing the string length between the string break point and the string attachment point as a function of the coefficient of friction and the deflection angle at the break point. The patent purportedly discloses novel designs of the components of the string suspension system, including the bridge, the saddle, the nut, and the tuning machine. The various embodiments of the invention provide adjustment in one or two dimensions while compromising or eliminating adjustments in the third. For instance, an embodiment providing for length and height adjustment provides no means for spacing adjustment. Additionally, the structural requirements of the saddles require the use of metals or artificial materials. Furthermore, the saddles cannot be replaceable easily and the height adjustment screws provide a restricted connection for the transfer of the energy of the vibrating string.

U.S. Pat. No. 4,497,236, to Rose, shows a fine tuning apparatus which functions as the bridge of a stringed instrument. It includes a base and a series of fine tuning elements, one for each string. Each fine tuning element includes a forward block and a saddle which is rotatable relative to the forward block. A string makes contact at a point on the saddle element and maintains surface contact with the saddle as the surface slopes downwardly and rearwardly from the contact point to a point where the string is clamped against the surface of an ear portion of the saddle. The rotatable position of the saddle can be adjusted relative to the forward block element, which results in a change in the tension of the string. However, the saddle cannot be adjusted for string spacing or string height, it cannot be easily replaced, and its structure requires that it be fabricated from metals or artificial materials.

U.S. Pat. No. 4,608,904, to Steinberger, discloses an anchoring and tuning mechanism that employs plug-ended strings slidably insertable into slots and cut-outs and tensioned by retraction of anchor members slidable in channels aligned with the strings. However, it does not provide means for harmonic tuning, or adjustment of the saddle in the longitudinal direction.

U.S. Pat. No. 4,649,788, to Matsui, teaches a bridge and means for mounting the rear end of each of a plurality of strings on the bridge. The bridge includes a plurality of saddles to which strings are individually attached. Each saddle is adjustable longitudinally for harmonic tuning and the saddle is adjustable for pitch without varying the effective length of the string. However, as with the patent to Rose, the saddle cannot be adjusted for string spacing, it is not easily replaceable, and its structure requires that it be fabricated from metals or artificial materials. This bridge also requires the use of a considerable number of mechanical elements which could weaken the rigidity of the saddle or rattle.

U.S. Pat. No. 4,672,877, to Hoshino et al., discloses a tailpiece and bridge assembly, comprising a pivotable housing attachable to the body of the instrument at the tailpiece. The pivoting movement of the housing provides for slight height adjustments in the strings, but it does not provide for longitudinal or lateral adjustments of the strings.

Finally, U.S. Pat. No. 5,520,082, to Armstrong et al., teaches a tremolo device for adjusting the string tension, which includes a base plate attached to the body of the instrument and a movable plate having first and second edges extending in a direction perpendicular to the strings. The movable plate is mounted to the base plate along the second edge of the movable plate about a pivot axis and in a horizontal position with its longitudinal axis perpendicular to the strings. The first edge of the movable plate is adapted to securely anchor the second end of each of the strings. The tuning devices are manually operable to stretch the associated strings between itself and the movable plate to apply a preselected tension force to each of the strings which bias the movable plate in a first direction of rotation about the pivot axis. The saddles can be adjusted for string length and string height only. Furthermore, the method of adjusting the string lengths is difficult and imprecise, requiring that manual force be applied to the string before the saddle is tightened into position.

Other known devices include two adjustable bridge designs manufactured by Schaller Electronic, An der Heide 15, D-92353 Postbauer-Heng, Germany, one denominated the STM system, and the other denominated the 3-D6. Each system is well known in the industry. These bridges have individual saddles, each with a lateral threaded rod inserted into it. The rod receives a small threaded cylinder, known as a roller, which has a central groove that catches the string. When the roller is turned, it moves laterally and string spacing adjustments can be made. A shortcoming of the design is that the string is held by a moving part (namely, the roller) which cannot be completely rigid. Additionally, the design has a poor saddle-to-bridge contact. The flow of energy must go through the small roller, through the threaded lateral rod and then down into the body, which is a very indirect path. Furthermore, the roller and the rod are required to be made out of metal.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

It is a general object of the present invention to provide an adjustable bridge system for a stringed instrument comprising a plurality of adjustable bridge elements that provide length, height and spacing adjustment of the strings.

It is a further object of the present invention to provide an adjustable bridge system or bridge assembly having saddles that do not require the insertion of moveable mechanical elements such as screws and/or do not require to be adjusted by mechanical elements which apply a pressure upon the saddles greater than the pressure applied by the string.

It is another objection of the present invention to provide an adjustable bridge system having saddles that are significantly simplified in their function so as to improve their reliability and longevity and in order to avoid the rattles of free moving parts.

It is still another object of the present invention to provide an adjustable bridge system having saddles that can be fabricated from many different materials to provide the instrument with new qualities and variations of sound such as a preferred neutral sound.

Yet another object of the present invention is to provide an adjustable bridge system having saddles that are attached to the bridge with improved rigidity.

A further object of the present invention is to provide an adjustable bridge system having saddles that transfer the string energy with improved efficiency in order to improve the resonance of the instrument.

A still further objection of the present invention is to provide an adjustable bridge system having saddles that can easily be removed and replaced by the user without the use of tools and without the need to re-adjust them to the desired position, in order to benefit from the choice of saddles newly made available and in order to simplify repairs.

Other novel features which are characteristic of the invention, as to organization and method of operation, together with further objects and advantages thereof will be better understood from the following description considered in, connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

According to the present invention, there is provided an adjustable bridge assembly having a plurality of separate but identical bridge elements. The adjustable bridge elements provide each string with length, height and lateral adjustments. The assembly provides multiple saddles which are not required to be interconnected to a bridge base in the manner of the prior art. The mechanical function of the saddle is significantly simplified and the saddle can be fabricated from a number of suitable and acoustically advantageous materials not used in the prior art, particularly including materials with improved sound transfer capabilities. The mechanical simplicity of the saddle also improves the reliability and the longevity of the saddle. Each saddle is attached to the bridge element in a manner which improves the rigidity of the saddle. Each saddle is also provided with a height adjustment element with improved sound transfer capability. The bridge assembly also provides multiple saddles which can each be easily removed and replaced by the user without the use of tools and without the need to re-adjust them to the desired position. As a result the user can readily experiment with saddles made from a wide choice of materials and the user can repair his bridge himself. The present invention also provides a bridge element for use in a bridge assembly which is readily adaptable to many different types of stringed instruments. In short, the present invention provides a novel way to intonate any solid-body instrument of the guitar family. The bridge element of the present invention substantially facilitates the design of an adjustable bridge assembly.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the Receiving Office and selected national patent offices and the public generally, and especially the engineers and other practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawing wherein.

DRAWING REFERENCE NUMERALS

FIGS. 1–8

Figures 1, 2:
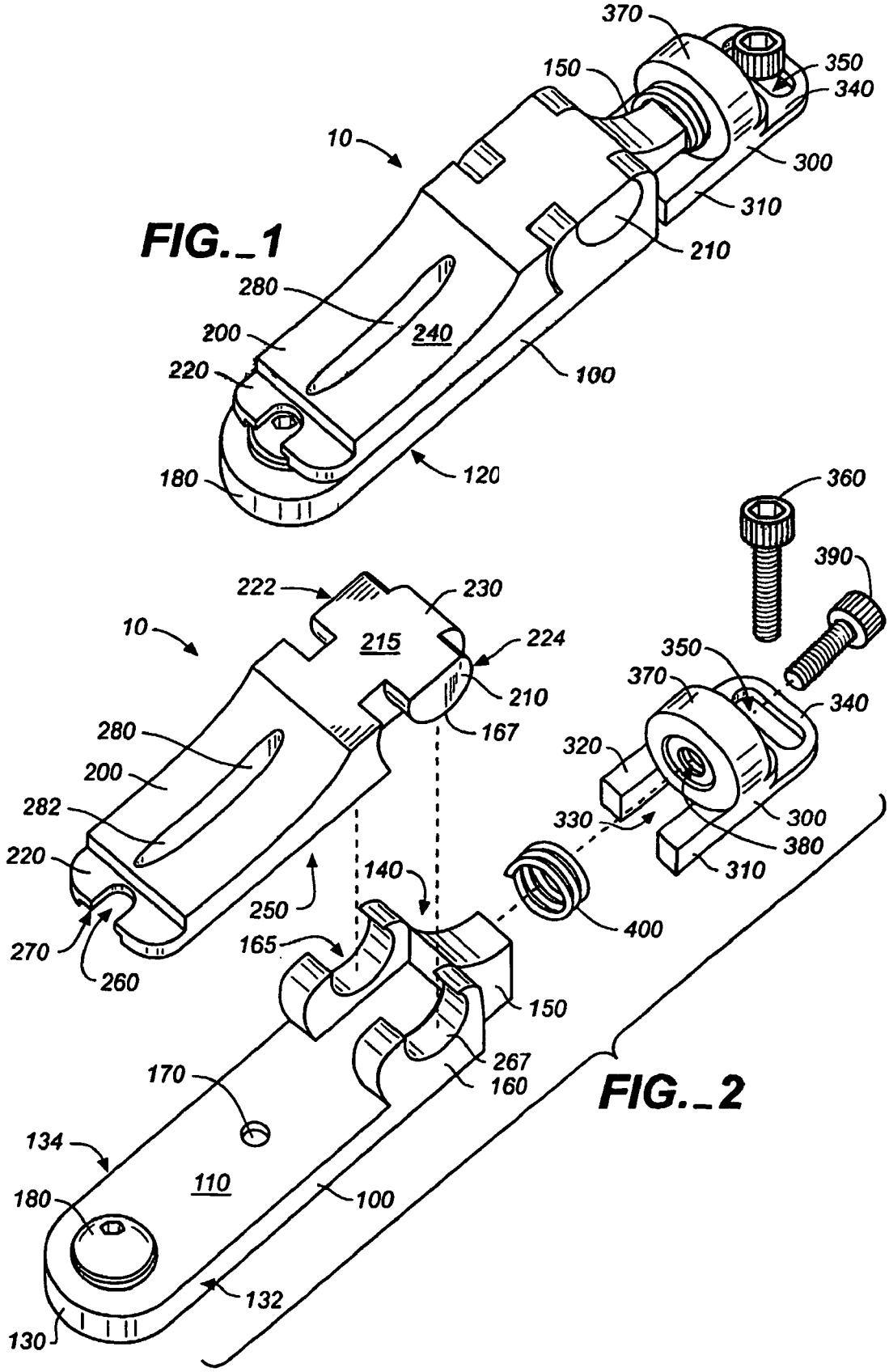
FIG. 1 is a perspective view of a discrete bridge element of the adjustable bridge system of the present invention.
FIG. 2 is an exploded perspective view of the bridge element of FIG. 1.

10 adjustable bridge element
20 saddle/base unit
100 structural base
110 top side of structural base
120 bottom side of structural base
130 front end of structural base
132 right side of structural base
134 left side of structural base
140 rear end of structural base
150 rear extension
160 structural base bracket
165 annular opening(s) of structural base bracket
165*a* widest diameter of annular openings of base bracket
165*b* narrowed uppermost portion of the annular openings of base bracket
167 curved surface of structural base approximated to and concentric with curved surface 267 of saddle
170 throughhole
175 conical or hemispherical recess
180 height adjustment screw
190 threaded bore
200 saddle
210 saddle axle
215 truncated top surface of saddle axle
215*a* widest diameter of saddle axle
215*b* dimension of narrow chord defined by truncation of saddle axle
220 front end of saddle
222 right side of saddle
224 left side of saddle
230 rear end of saddle
240 top side of saddle
250 bottom side of saddle
260 channel.
267 curved surface of saddle approximated to and concentric with curved surface 167 of structural base
270 hemispherical recess
280 longitudinal channel
282 proximal end of longitudinal channel
284 distal end of longitudinal channel
290 saddle hole
300 control anchor
310 arm
320 arm
330 receiving slot
340 ring
350 elongate opening
360 anchoring screw
370 raised structure
380 throughhole in raised structure
390 longitudinal adjustment screw
400 biasing spring
500 top surface of musical instrument
510 musical instrument body
520 hole in musical instrument body
530 expansion on musical instrument string
540 retaining nut
550 bottom of musical instrument body
600 instrument string

FIGS. 9–12

700 multi-element-control anchor (assembly base)
710 base portion
720 side-by-side slots
730 terminal end of slots
740 vertically disposed wall
750 throughholes in vertically disposed wall
760 holes for anchoring screws
770 angle of vertically disposed wall

BEST MODE FOR CARRYING OUT THE INVENTION

Figure 3A:
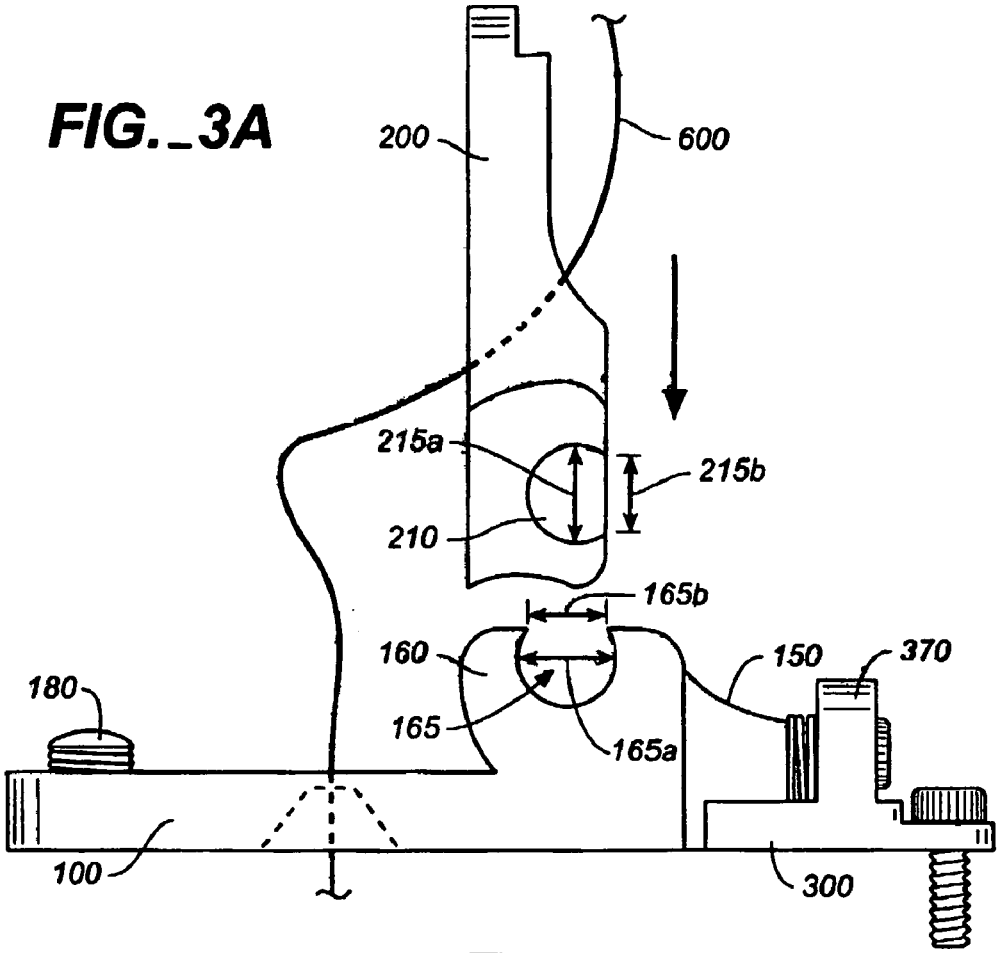
FIG. 3A is a side view in elevation of the inventive adjustable bridge element, showing the saddle poised for insertion into its supporting base.
Figure 3B:
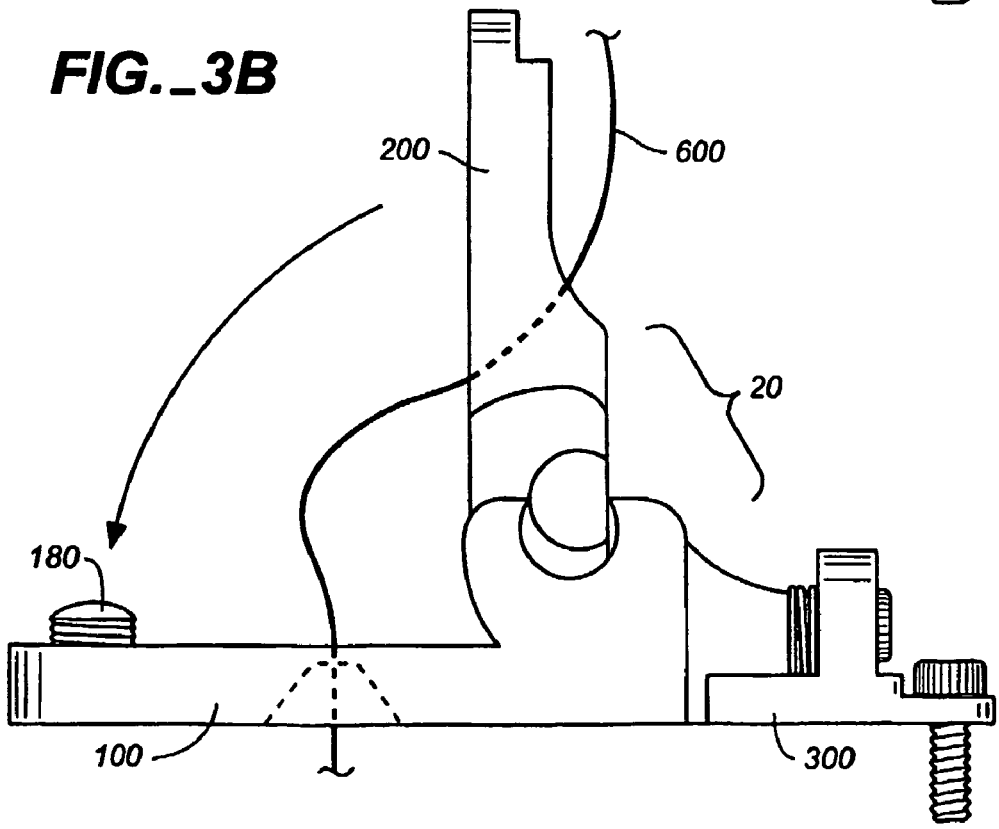
FIG. 3B is a side view in elevation of the system, illustrating the saddle element fully articulated into a vertical position within the supporting base.
Figure 4:
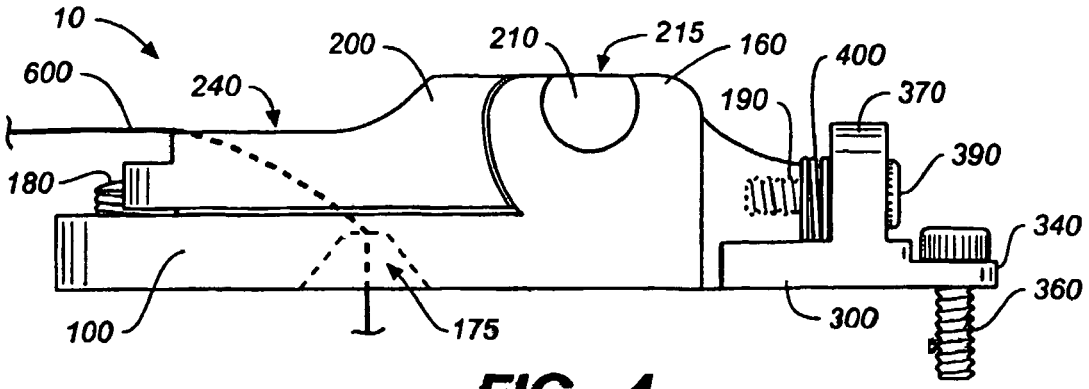
FIG. 4 is a side view in elevation showing a string (in phantom) disposed through the bridge element.

Referring to FIGS. 1 through 12, wherein like reference numerals refer to like components in the various views, FIGS. 1 through 8 show the bridge element comprising the basis for a bridge assembly of the present invention. These views collectively show that the adjustable bridge system of the present invention comprises a plurality of adjustable bridge elements, each bridge element generally denominated 10 herein. In its most essential aspect, the bridge element of the inventive bridge system of the present invention comprises three primary components, including a structural base 100, a saddle 200, and a control anchor 300. The structural base includes a top side 110 (preferably substantially planar), a generally planar bottom side 120, a front end 130, a right side 132, a left side 134, a rear end 140, a rear end extension 150, and a structural base bracket 160. The structural base further includes a throughhole 170 extending from the bottom side through the top side and adapted for insertion of an instrument string 600. Proximate the front end of the structural base 130 is a round head height adjustment screw 180 threadably inserted into a threaded hole. Rear end extension 150 includes a horizontally disposed threaded bore 190 (see esp. FIG. 4), which accommodates a longitudinal adjustment screw. Throughhole 170 includes a downwardly expanding conical recess 175, which allows the string to be threaded through the structural base without being obstructed or snagged at the bottom of the structural base, regardless of where the bridge element has been positioned, and which also aligns the string within its saddle after it exits the supporting base.

The adjustable bridge element further includes a saddle 200 positioned and hingedly mounted on the structural base with a saddle axle 210 disposed on a structural base bracket 160. In adjustment operations, the saddle moves in unison with the structural base in the longitudinal and lateral directions. While generally cylindrical and having a substantially annular cross section, the saddle axle 210 has a truncated top surface 215 which allows for perpendicular insertion into, and removal from, structural base bracket 160. This is a hinging mechanism whereby structural base bracket 160 has open, truncated annular openings 165 which have a diameter substantially equal to the diameter of the saddle axle 210. An optimum hinge is achieved by truncating the openings by one fifth of their diameter and by truncating the saddle axle by one fifth, or slightly more, of its diameter. Thus the saddle 200 can be inserted perpendicularly into the gaps of the annular openings and the saddle 200 can be rotated to form the greater portion of a complete hinge.

The saddle includes a front end 220, a right side 222, a left side 224, a rear end 230, a top side 240, and a bottom side 250. The front end 220 of the saddle includes a channel 260 through which the hex hole of height adjustment screw is exposed when the saddle is positioned on the structural base (FIG. 1). The bottom side of the front end further includes a hemispherical recess 270 shaped to conform to and maximally engage the height adjustment screw. The top side 240 of the saddle includes a longitudinal channel 280 having a proximal end 282 and a distal end 284 and a saddle hole 290 proximate the distal end. The saddle hole 290 is disposed immediately above throughhole 170 of the supporting base when the saddle is fully rotated downward such that the bottom side 250 of saddle 200 is roughly approximated to the top surface portion 110 of the supporting base 100. The string of the instrument is supported by and cradled in the channel as it extends from the saddle hole toward the instrument nut.

Preferably, surfaces 167, 267, of the structural base bracket and the saddle are approximated to one another and concentrically curved in relation to the center of the saddle axle so as to allow free pivoting of the saddle with tight tolerances.

When saddle 200 is secured on the structural base 100 the combination forms a functional saddle/base unit 20.

The final primary component of the adjustable bridge element is a control and/or 300 disposed at the rear of the supporting base. The function of the control anchor is to complement string pressure in securing the bridge element to the front surface of the instrument body, to provide for longitudinal and lateral adjustment of the instrument string, and to prevent the bridge element from dislodging when its bolt is loosened for lateral adjustment. The control anchor includes two arms 310, 320 forming a receiving slot 330, which accommodates the rear extension of the supporting base with a tight fit so as to prevent the supporting base from independently pivoting or moving laterally.

The rear of the control anchor includes an integral ring 340 having an elongate opening 350 which permits a measure of lateral adjustment of the control anchor before anchoring screw 360 is tightened down. Interposed between ring 340 and arms 310, 320, is a raised structure 370, preferably having a threaded throughhole 380 through which longitudinal adjustment screw 390 is disposed to threadably insert into the threaded bore 190 of the rear extension 150 of structural base 100. A biasing spring 400 is disposed on longitudinal adjustment screw 390 and is interposed between the rear extension 150 and raised structure 370 when the control anchor is connected to the structural base.

As will be readily appreciated, the elongate opening 350 in ring 340, along with anchoring screw 360, provides a combined attachment means/lateral adjustment means. Also, as will be readily appreciated, while the instrument string is kept taut, turns of longitudinal adjustment screw 390 will move the saddle/base unit 20 along the longitudinal axis, its rear extension sliding inside the two arms of the control anchor. The string is lengthened by tightening the adjustment screw and the string is shortened by loosening the adjustment screw.

It will be further appreciated that the anchor ring hole is elongated so that the rear of the anchor can move laterally relative to anchoring screw 360 and further allows for pivoting of the saddle/structural base unit. In a bridge assembly, each of the bridge elements are spaced apart from adjoining bridge elements to permit lateral movements of each adjustable element. The spacing of the string may thus be adjusted by loosening the anchoring screw 360, repositioning the ring around the screw, then by re-tightening the screw. This can be accomplished without the need to loosen the instrument string.

Finally, it will be readily appreciated that because the saddle need not move independently of its structural base longitudinally or laterally, vertical movement can be achieved through adjustments of a single height adjustment screw 180 moveable in the vertical direction and situated in the front of the structural base and upon which rests the front of the saddle. These adjustments can be made even after a string has been installed and is under tension typical of an instrument ready to be played.

Repairs of worn parts are easily accomplished. For instance, the saddle is removed by simply rotating it backwards until the axle 210 can be disengaged perpendicularly out of the annular openings 165 of the structural bracket 160. No tools are needed. It should be noted that once a saddle is replaced by another, it is hinged automatically in the exact location occupied by the previous saddle. Therefore, the user will usually not need to make positional adjustments after changing saddles.

In closing, it should be noted that the bridge elements should preferably be initially positioned on the instrument body by taking into consideration the two separate compensation requirements for the harmonic tuning of the outer strings. The lower string will require a greater amount of compensation than the higher string and the bridge elements will be positioned at a slight slant which is determined by the approximate difference of these two compensation requirements. Therefore conical hole 175 corresponding to the lower string is not required to be wider than conical hole 175 corresponding to the higher string, and additionally arms 310 and 320 corresponding to the lower string can engage the rear extension 150 by nearly the same distance as do the arms 310 and 320 corresponding to the higher string. Thus arms 310 and 320 provide the outer bridge elements with the same amount of lateral rigidity.

Figure 5:
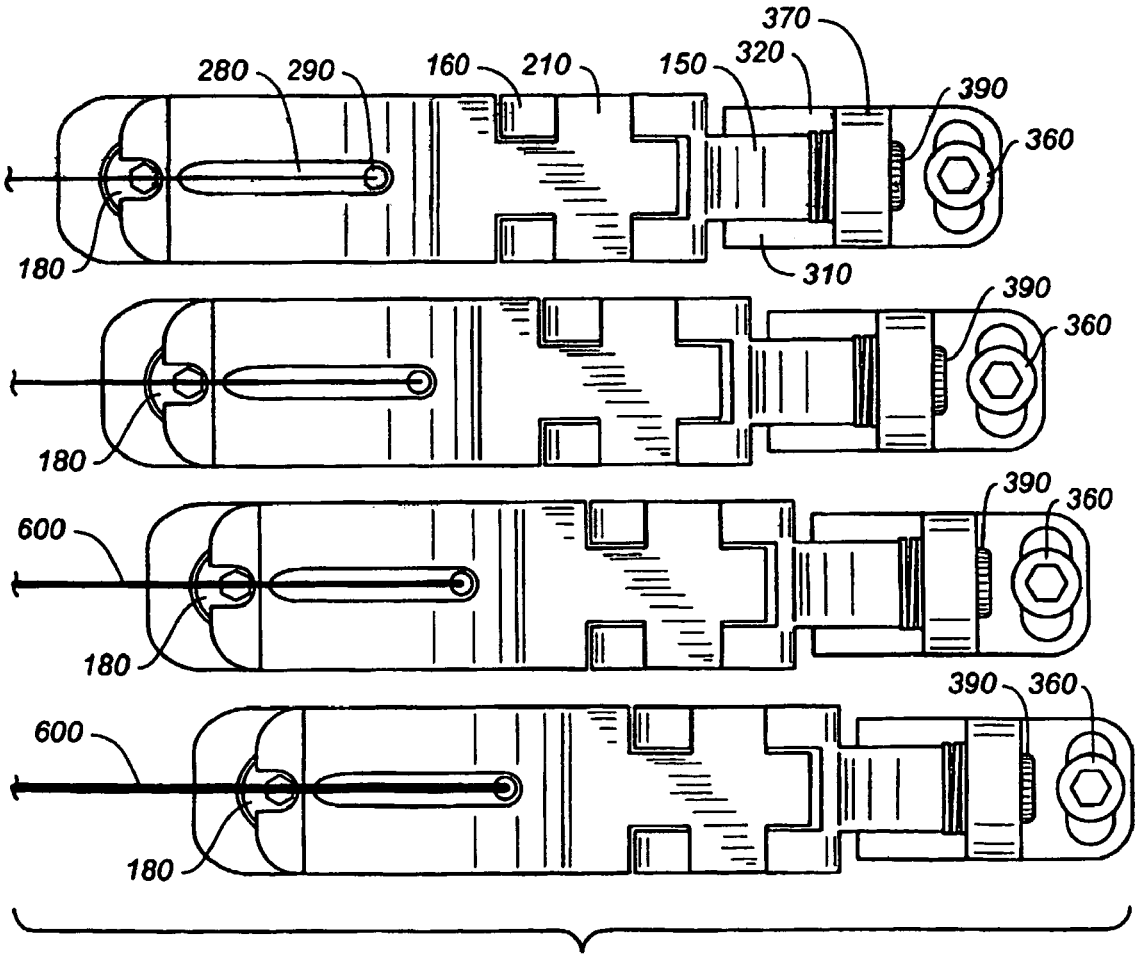
FIG. 5 is a top plan view showing a plurality of bridge elements comprising a non-slanted assembly adapted for use on a four-string instrument, such as a base.
Figure 6:
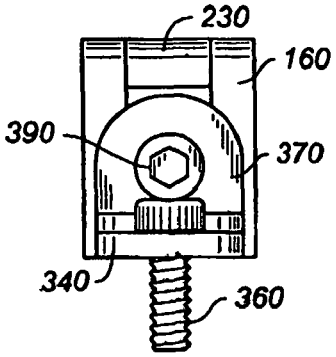
FIG. 6 is an end view in elevation of the inventive bridge element as viewed from anchor end of the bridge element.
Figure 7:
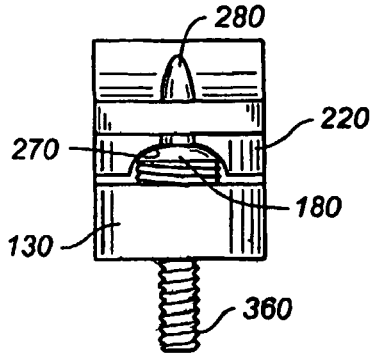
FIG. 7 is an end view in elevation of the bridge element as viewed from the front end.

Referring now to FIG. 5, which is a top plan view showing a plurality of bridge elements comprising an assembly adapted for use on a four-string instrument, it can be seen that side-by-side bridge elements are provided with ample room for lateral adjustments. Means for each of the LHS adjustments are also readily apparent, including height adjustment screw 180, longitudinal adjustment screw, and anchoring screw 360.

Figure 8:
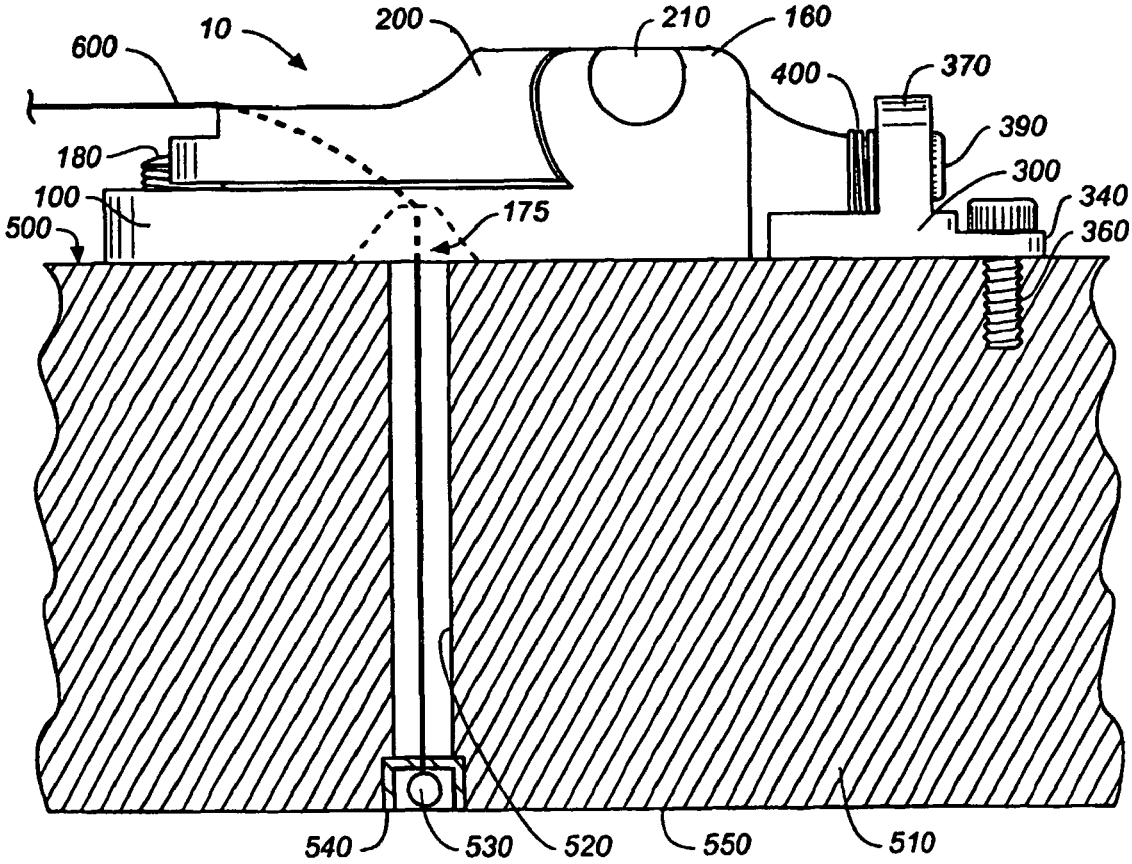
FIG. 8 is a partial cross-sectional side view in elevation showing a bridge element mounted on an instrument body, and particularly illustrating how an instrument string is threaded through and anchored in the instrument body.

Referring now to FIG. 8, which is a partial cross-sectional side view in elevation showing a bridge element 10 mounted on the top surface 500 an instrument body 510, it will be seen that instrument string 600 is threaded through a hole 520 in the instrument body 510. The string includes an integral expansion 530 which is captured and retained by a retaining nut 540 disposed in the bottom 550 of the instrument body. Preferably, the conical opening 175 at the bottom 120 of structural base 100 is sized with a diameter approximately twice that of hole 530 through instrument body 520. Hole 530 must also be sized with a diameter significantly greater than the diameter of the instrument string 600 so as to allow for the desired range of movement of the structural base in adjustments.

Figure 9:
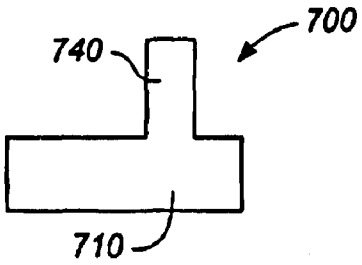
FIG. 9 is a side view in elevation of a multi-element control anchor (or assembly base) adapted for installation of six saddle/base units of the adjustable bridge elements of the present invention.
Figure 10:
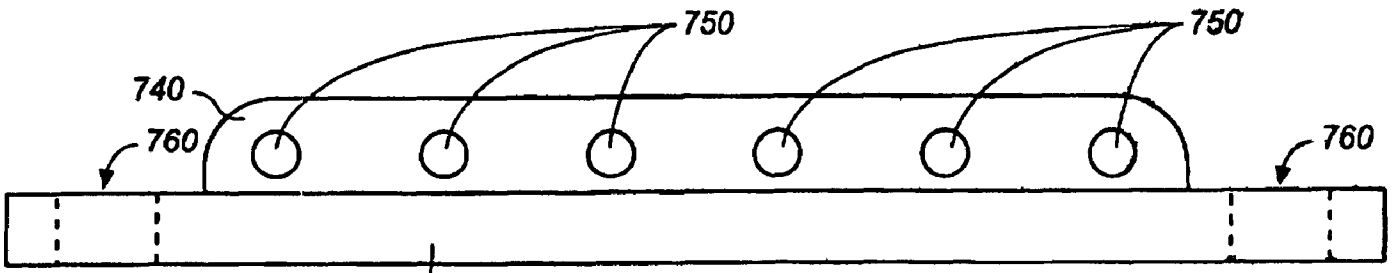
FIG. 10 is a rear view of the assembly base of FIG. 9.
Figure 11:
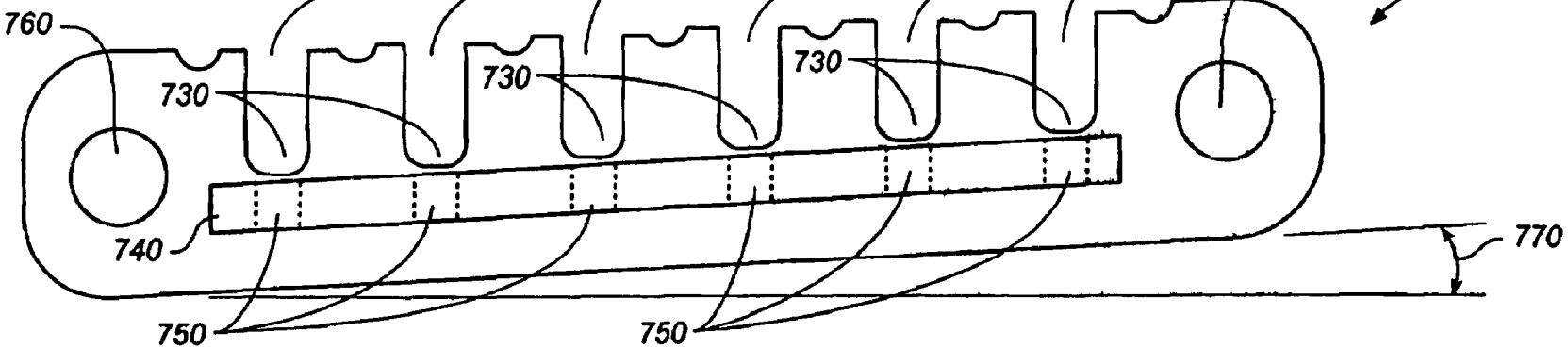
FIG. 11 is a top plan view of the assembly base of FIGS. 9 and 10.

Referring now to FIGS. 9–11, illustrated is a multi-element control anchor (or assembly base) 700 adapted for the installation of six independent saddle/base units. The multi-element anchor includes a base portion 710 having side-by-side slots 720 suited to accommodate the rear extensions of the structural bases (as with the arms of the above-described control anchor). Abutting the terminal end 730 of each recess is a vertically disposed wall 740 having a plurality of throughholes 750, each positioned above and projecting rearwardly from a slot. The base portion 710 further includes two holes 760 for anchoring screws (not shown). The vertically disposed wall is preferably set at a 2–35' angle such that the strings progressively shorten in length from their connection at the saddle to their contact point over the instrument nut.

Figure 12:
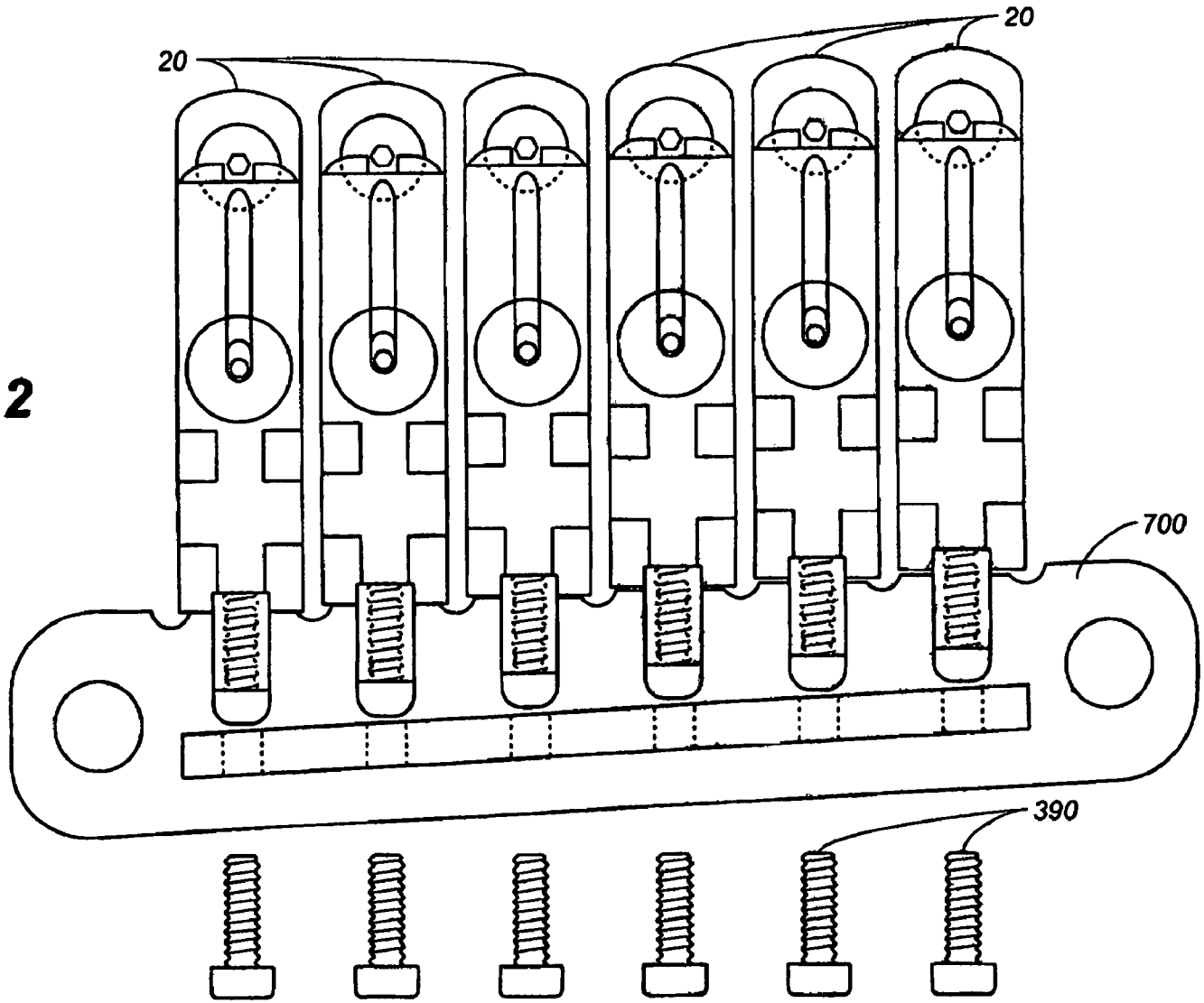
FIG. 12 is a top plan view showing six bridge elements installed on the assembly base of FIGS. 9–11, not showing the biasing springs or anchoring screws.

FIG. 12 is a top plan view showing six saddle/base units 20 installed on the assembly base. In this configuration for a six-string guitar with a common 2.095 inches string spread, only height and length adjustments of the strings are provided. While this assembly sacrifices lateral adjustments of the strings it benefits from the fact that it has one single anchor 700, which is somewhat easier to mount on a guitar than six separate anchors. It is easier to manufacture such a single anchor 700. The anchor 700 has a 2–35' angle slant to account for the difference in the compensation requirements of the outer strings as has been discussed previously. This difference is nearly 0.10 of an inch. Thus in FIG. 12, the saddle for the lower string is shown to be nearly 0.10 of an inch further from the nut than the saddle for the higher string.

In another aspect the present invention may be characterized as an adjustable bridge system, comprised of separate and identical bridge elements for each of the strings of the instrument. Each bridge element has a width which is smaller than the initial string spacing and comprises mainly a structural base, a saddle, and an anchoring device designated a control anchor. The rear of the saddle is positioned atop a support bracket at the rear of the structural base to form a hinged joint. To adjust the string height, the front end of the saddle is raised or lowered by a single adjuster, preferably a height adjustment screw, which also supports the front of the saddle. The support of the height adjustment screw and the support of the hinge combine to provide a saddle with significant rigidity. The rear of the anchor is preferably secured to the instrument by an anchoring screw disposed through an elongate hole which allows some latitude in the positioning of the control anchor on the instrument body. The front of the control anchor is connected to the back of the supporting base with a second (longitudinal) adjustment screw, thereby securing the bridge element to the instrument and further providing a string length adjuster, which slides the structural base relative to the control anchor and over the body of the instrument in the L longitudinal direction. The anchoring screw is loosened to reposition the bridge element in the lateral (S) direction over the instrument, in order to adjust the string spacing. Therefore the present invention provides a plurality of adjustable bridge elements, which when disposed in an assembly of side-by-side elements forms an adjustable bridge which has separate supporting bases that can be repositioned independently in the longitudinal and lateral dimensions. As a consequence, the mechanisms for these two separate adjustments are not required to engage the saddle itself.

The instrument string is threaded from the bottom of the instrument, through the body of the instrument, and then through a hole of the structural base where it contacts the structural base through a longitudinal slot of the saddle. The hole keeps the string aligned with the longitudinal slot of the saddle. The string is secured at the bottom of the instrument and comes to rest on the front of the saddle. The tightened string applies a downward pressure and a forward pull on both the structural base and on the saddle. Therefore the bridge element is secured to the instrument by a combination of the string's downward pressure exerted on the base and the saddle by the secured anchor.

The height adjustment screw which supports the front of the saddle and which adjusts the string height (H) is screwed through the structural base and is not screwed through the saddle, as are known prior art height-adjusting screws. The screw is centrally located underneath the point at which the string vibrates at the saddle. The screw is preferably as wide as possible in relation to the width of the structural base and it has a rounded head which contacts a matching cavity or recess in the underside of the saddle. The front end of the saddle has a portion including a recess which contacts the head of the height adjustment screw. The recess is slightly elongated so that a maximum of contact is provided after a height adjustment. This also serves to transfer the energy of the vibrating string with improved efficiency and to additionally provide the front of the saddle with a significant amount of lateral stability. The height adjustment screw can be adjusted by a curved hex wrench (or functionally comparable tool suited to rotate the screw), which tool is inserted underneath the string.

Due to its structural configuration, the saddle can be mounted on the structural base and removed without the use of tools. At one end the saddle is provided with a fixed lateral axle, which traverses a longitudinal gap of the saddle. Alternatively, the saddle is provided with a fixed lateral axle which extends from both sides of a central portion of the saddle. The axle can be a fixed rod which is inserted through the saddle or it can be integral with and shaped out of the saddle itself. The generally cylindrical axle is truncated at its top such that it has a flat upper surface. The saddle is mounted by inserting the narrow portion of the axle straight down into a open bracket of the structural base (see esp. FIGS. 3A, 3B). The widest transverse dimension 215*a* of the saddle axle 210 is substantially equal to, or very slightly greater than, the greatest diameter 165*a* of the annular openings of the structural base bracket, such that when the saddle is rotated downwardly it is firmly snapped into, and pivotally captured by, the structural base bracket. The strength and rigidity of the hinging mechanism can be optimized by truncating the saddle axle by one fifth of its diameter. The narrowed uppermost portion 165*b* of the annular openings of the base bracket will equal or will be slightly wider than the narrow portion (chord dimension) 215*b* of the truncated axle of the saddle.

The rear of the structural base and the rear of the saddle match each other very closely such that a maximum amount of contact exists between them. This provides the saddle with improved lateral stability and improved longitudinal stability. The saddle can be removed by simply rotating the saddle upwardly so that the truncated axle can be disengaged from the structural base bracket. This upward rotation of the saddle can be initiated by pressing down on the rear end of the saddle with one's finger. This will lift the front of the saddle, which can then be manually grasped to complete the upward rotation. No tool is required. If the saddle is replaced by another saddle of similar dimensions, the latter saddle will occupy the exact location occupied by the former saddle. Therefore, the user will not be required to make any adjustments after replacing a saddle.

The anchor is secured to the instrument by a fastening element such as a screw inserted through a ring at the back of the anchor and screwed perpendicularly into the body or into the top plate of the instrument, so that the head of the screw presses down on the sides of the ring. The elongate opening of the ring is wider laterally than the securing screw to allow the bridge element to be repositioned in the lateral direction (S) in relation to the screw, which has a fixed position on the instrument. The anchor has one or several frontal extensions (arms) which tightly engage a rear extension at the back of the structural base so that the rear extension of the structural base slides into the opening formed by the arms of the control anchor. When so positioned, the elements remain rigid in relation to one another in latitudinal direction.

The medial portion of the control anchor has a raised lateral structure with a hole. A fastening element such as a screw is inserted though this hole and is screwed longitudinally into the rear extension of the structural base. The head of the screw is stopped at the hole so that when this screw is turned clockwise the structural base will slide backward over the body of the instrument and into the anchor. When the screw is turned counterclockwise the tensioned string will pull the structural base forward over the instrument and out of the anchor. A biasing spring is inserted around the screw to urge the structural base away from the anchor. Thus the structural base and its mounted saddle can be repositioned in the longitudinal direction (L) when the string is not yet strung nor tightened sufficiently to pull the saddle forward. It should be noted that the biasing spring exerts a downward pressure upon the structural base. Neither this pressure nor the additional downward pressure of the string are sufficient to impede the base from sliding over the instrument during a string length adjustment. Yet both of these pressures suffice to provide the base with lateral stability.

As will be readily appreciated, in accordance with the present invention there is provided a novel bridge element that facilitates length, height and spacing adjustment for the string while also providing a saddle not requiring an interconnection with a prior art mechanical element. This results in a saddle with a greatly simplified mechanical function. The saddle can accordingly be fabricated from a wide array of materials not appropriate to the prior art. Such materials include bone, ivory, glass, semi-precious stones, crystal, hardwood, walrus ivory, Corian, mammoth tusk, wood, plastics and so forth. Each material will introduce a characteristic variance to the overall sound of the instrument to suit the preferences of the user, such as a desired neutral sound. The mechanical simplicity of the saddle also improves its durability and reliability and serves to eliminate the potential rattles of free moving parts.

The inventive bridge element system utilizes a common through-the-body configuration of stringing the instrument such that each string is provided with a hole through the body of the instrument. Whereas in the prior art the hole is only large enough to allow the string to pass through, in connection with the present invention the hole must have a greater diameter. Because the structural base of the saddle is repositioned laterally and longitudinally over the body of the instrument while the string stays aligned with its saddle, the diameter of the hole should preferably be large enough so that the string never contacts the upper edge of the hole following an adjustment. This would adversely weaken the downward pressure exerted by the string on the structural base and/or would exert a lateral pull that could obstruct the lateral adjustment of the bridge element. On an electric guitar, for example, the diameter would nearly be 0.17 of an inch. Stated differently, the diameter of the hole will usually be wide enough to provide for satisfactory string length and string spacing adjustments. The hole can also be elongated in either the longitudinal or the latitudinal direction in order to increase the amount of available adjustment for either the string length or the string spacing. A plurality of holes will preferably be located on the instrument by taking into account the compensations required to intonate the outer strings. Thus the outer strings will each be provided with a hole having a center located such that each of these strings reaches its saddle at a distance from the nut which nearly equals the sum of the scale length plus the compensation length. For example, a six string electric guitar typically requires that the thinnest string be compensated or lengthened by nearly 0.06 inches while the thickest string is required to be compensated by nearly 0.16 inches. Thus in this instance the center of the hole for the thickest string will be located nearly 0.10 inches further from the nut of the instrument than the center of the hole for the thinnest string. This serves to minimize the size of the holes through the body and the size of the wider portion of the conical hole through the structural base. Additionally the required ranges of length adjustments of the strings are also kept at a minimum such that the arms of the various anchor are more efficient at providing for lateral stability of the various bridge elements.

The string is threaded through a hole in the structural base. The hole is preferably a conical hole which has an opening at the bottom of the structural base which is larger than the hole through the instrument and which narrows upwardly toward the top side of the structural base. This allows the string to be threaded through the structural base without ever being obstructed by the bottom of the structural base and this also aligns the string with its saddle after it exits the structural base. Therefore the diameter of the hole at the bottom of the structural base approximately equals twice the diameter of the hole through the instrument minus half the diameter of the hole at the top of the structural base. On an electric guitar, for example, the diameter of the hole at the bottom of the structural base equals nearly 0.30 of an inch. The hole at the bottom of the structural base can be elongated in either the longitudinal or the latitudinal direction in order to increase the amount of available adjustment for either the string length or the string spacing.

The bottom side of the structural base and of the control anchor may be a curved surface to accommodate a stringed instrument with a curved soundboard.

According to another aspect of the invention the separate structural bases and saddles of the bridge elements can also be attached to the instrument by the use of a single anchor as shown in FIG. 12. In this configuration there is no adjustability of the string spacing. However, the advantage to using a single anchor resides in its convenience in use: it is more convenient to attach it to the instrument than multiple anchors and fewer parts are required to be manufactured and to be assembled. Nevertheless, the functional advantages of the above-described bridge element still obtain, and the ease with which it can be adjusted longitudinally and vertically is not compromised or diminished in any fashion in this more unified configuration.

Characterized yet another way, and distilled to its most essential aspect, the present invention is a bridge element for use in an adjustable bridge for a stringed instrument, comprising a control anchor having combined attachment means and lateral adjustment means for securing the control anchor to the top surface of the body of the stringed instrument and for making lateral adjustments of the bridge element; a base spaced apart from the control anchor but slidingly connected to the control anchor with longitudinal adjustment means, and further including vertical adjustment means; and a saddle pivotally connected to the base and operatively engaging the vertical adjustment means.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. As an elementary example, it would be obvious to one having skill to modify the structural base bracket to comprise a single, unified female bracket spanning essentially the width of the structural base, rather than having opposing or side-by-side female parts. However, the snap fastening characteristics would not be appreciably altered with such a construction.

Accordingly, the proper scope of the present invention should be determined only by the broadest interpretation of the appended claims so as to encompass all such modifications as well as all relationships equivalent to those illustrated in the drawings and described in the specification.

What is claimed is:

1. A bridge element for an adjustable bridge for a stringed instrument, comprising:

a control anchor having combined attachment means/lateral adjustment means for securing said control anchor to the top surface of the body of the stringed instrument and for making lateral adjustments of said bridge element;

a structural base spaced apart from, and slidingly connected to said control anchor with longitudinal adjustment means, and further including vertical adjustment means; and a saddle pivotally connected to said structural base and operatively engaging said vertical adjustment means;

wherein said attachment means/lateral adjustment means comprises a combination ring integral with said control anchor, said ring having an elongate hole, and a screw inserted through the elongate hole such that when loosened, said control anchor may be moved laterally.

2. The bridge element of claim 1, wherein said longitudinal adjustment means comprises a horizontally disposed longitudinal adjustment screw inserted through said control anchor and into said structural base, such that turning said longitudinal adjustment screw changes the distance between said structural base and said control anchor.

3. The bridge element of claim 2, further including biasing means disposed on said longitudinal adjustment screw and interposed between said structural base and said control anchor.

4. The bridge element of claim 1, wherein said structural base includes a top side having a threaded hole, and wherein said saddle includes a bottom side, and wherein said vertical adjustment means comprises a vertical adjustment screw disposed in the threaded hole in said top side of said structural base and engages said bottom side of said saddle, such that by turning said vertical adjustment screw causes said saddle to pivot on said structural base.

5. In an adjustable bridge assembly for a stringed musical instrument in which the bridge assembly includes a plurality of bridge elements, an adjustable bridge element, comprising:

a structural base having a top side, a bottom side, a front end, a right side, a left side, a rear end, a rear end extension, a structural base bracket, a throughhole extending from said top side to said bottom side for insertion of an instrument string, height adjustment means proximate said front end and disposed in said top side;

a saddle hingedly mounted on said structural base bracket, wherein said saddle has a front end, a right side, a left side, a rear end, a top side, a bottom side, an integral saddle axle disposed in said structural base bracket, height adjustment access means, and a saddle hole, wherein when said saddle is positioned on said structural base and pivoted fully downward proximate said top side of said structural base, said bottom side of said front end operatively engages said height adjustment means and said height adjustment means is accessible for making string height adjustments after a string has been customarily installed and is under tension, and the saddle hole is disposed immediately above the throughhole in said supporting base;

a control anchor disposed at said rear of said supporting base, said control anchor having two arms which form a receiving slot to accommodate said rear extension of said supporting base, an integral ring having an elongate opening, and a raised structure interposed between said ring and said arms, said raised structure;

lateral adjustment means inserted through said control anchor ring to secure said control anchor to the body of the stringed instrument; and longitudinal adjustment means for operatively connecting said control anchor to said rear extension of said structural base.

6. The bridge element of claim 5, wherein said rear extension of said structural base includes a horizontally disposed threaded bore, said raised structure on said control anchor includes a threaded throughhole, and wherein said longitudinal adjustment means comprises a longitudinal adjustment screw threadably inserted into the bore and extending into the threaded throughhole, whereby turns of said longitudinal adjustment screw selectively separates and/or approximates said control anchor and said structural base.

7. The bridge element of claim 6, further including a biasing spring disposed on said longitudinal adjustment screw and interposed between said control anchor and said structural base.

8. The bridge element of claim 5, wherein said throughhole in said structural base includes a downwardly extending truncated conical recess.

9. The bridge element of claim 5, wherein said height adjustment screw has a round head and said bottom side of said saddle includes a recess conforming to and engaging said round head when said saddle is pivoted downwardly such that said bottom side of said saddle and said top side of said structural base are brought into close proximity.

10. The bridge element of claim 5, wherein said saddle further includes a longitudinal channel which extends from the saddle hole to proximate the front end of said saddle.

11. The bridge element of claim 5, wherein said structural base bracket has truncated annular openings having a widest diameter substantially equivalent to the widest diameter of said saddle axle.

12. The bridge element of claim 5, wherein said saddle axle is truncated by one filth of its diameter, and wherein said structural base openings are truncated by one fifth of their diameters.

13. The bridge element of claim 5, wherein said structural base bracket and said saddle having approximated curved portions concentrically defined by said saddle axle.

14. The bridge element of claim 5, wherein said lateral adjustment means comprises an anchoring screw disposed through the elongate opening in said ring, selectively loosened and tightened to permit said control anchor to move laterally on the instrument body.

15. The bridge element of claim 5, wherein said structural base includes a threaded bore and said height adjustment means comprises a height adjustment screw disposed in the threaded bore and engaging said bottom side of said saddle.

16. The bridge element of claim 15, wherein said height adjustment access means comprises a slot disposed in said front end of said saddle.

17. An adjustable bridge system for a stringed instrument for providing longitudinal and vertical adjustment of individual strings, comprising:

a multi-element control anchor, having a base portion with side-by-side slots, each slot having a terminal end, a vertically disposed wall abutting said terminal ends and having a plurality of throughholes, each positioned above and projecting rearwardly from one of the slots, and at least one hole for an anchoring screw, wherein said vertically disposed wall is set at an angle such that the strings progressively shorten in length as measured from their connection at said saddle to their contact point over the musical instrument nut;

a plurality of spaced-apart bridge elements generally disposed in a side-by-side relationship, each of said bridge elements installed on said multi-element control anchor, and each of said bridge elements including a structural base spaced apart from, and slidingly connected to, said multi-element control anchor with longitudinal adjustment means, and further including vertical adjustment means; and a saddle pivotally connected to said structural base and operatively engaging said vertical adjustment means.

18. The bridge element of claim 17, wherein said longitudinal adjustment means comprises a horizontally disposed longitudinal adjustment screw inserted through said vertically disposed wall and into said structural base, such that turning said longitudinal adjustment screw alters the spacing between said structural base and said multi-element control anchor.

19. The bridge element of claim 18, further including biasing means disposed on said longitudinal adjustment screw and interposed between said vertically disposed wall and said base.

20. The bridge element of claim 18, wherein said base includes a top side having a threaded hole, and wherein said saddle includes a bottom side, and wherein said vertical adjustment means comprises a vertical adjustment screw disposed in the threaded hole in said top side of said base and engages said bottom side of said saddle, such that by turning said vertical adjustment screw causes said saddle to pivot on said structural base.

* * * * *